US006074034A

United States Patent [19]

Maeda

[11] Patent Number: 6,074,034

[45] Date of Patent: Jun. 13, 2000

[54] LIQUID JET RECORDING HEAD INCLUDING A TEMPERATURE SENSOR

[75] Inventor: Hiroyuki Maeda, Yokohama, Japan

[73] Assignee: Canon Kabushiki Kaisha, Tokyo, Japan

[21] Appl. No.: 08/308,197

[22] Filed: Sep. 19, 1994

Related U.S. Application Data

[63] Continuation of application No. 07/885,011, May 20, 1992, abandoned, which is a continuation of application No. 07/744,654, Aug. 9, 1991, abandoned, which is a continuation of application No. 07/474,401, Feb. 2, 1990, abandoned.

[30] Foreign Application Priority Data

Feb. 3, 1989 [JP] Japan ..... 1-25364
Feb. 3, 1989 [JP] Japan ..... 1-25365

[51] Int. Cl.[7] ..... B41J 2/05

[52] U.S. Cl. ..... 347/17; 347/167; 347/194

[58] Field of Search ..... 347/17, 14, 67, 347/191, 194, 189; 346/761 A

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,449,033 | 5/1984 | McClure | 347/194 |
| 4,459,600 | 7/1984 | Sato et al. . | |
| 4,463,359 | 7/1984 | Ayata et al. . | |
| 4,558,333 | 12/1985 | Sugitani et al. . | |
| 4,719,472 | 1/1988 | Arakawa | 347/17 |
| 4,723,129 | 2/1988 | Endo et al. . | |
| 4,740,796 | 4/1988 | Endo et al. . | |
| 4,896,172 | 1/1990 | Nozawa | 347/17 |
| 4,910,528 | 3/1990 | Firl | 347/17 |
| 4,914,562 | 4/1990 | Abe | 347/17 |
| 4,926,196 | 5/1990 | Mizoguchi | 347/23 |
| 4,947,194 | 8/1990 | Kyoshima | 347/14 X |

FOREIGN PATENT DOCUMENTS

| | | | |
|---|---|---|---|
| 48012628 | 2/1973 | Japan . | |
| 50-004912 | 3/1973 | Japan . | |
| 56865 | 4/1983 | Japan | B41J 3/04 |
| 59-123670 | 7/1984 | Japan | B41J 3/04 |
| 59-138461 | 8/1984 | Japan | B41J 3/04 |
| 2370 | 1/1985 | Japan | B41J 3/04 |
| 02258266 | 10/1990 | Japan | B41J 2/05 |
| 2-258266 | 10/1990 | Japan | B41J 2/05 |

*Primary Examiner*—Joseph Hartary
*Attorney, Agent, or Firm*—Fitzpatrick, Cella, Harper & Scinto

[57] ABSTRACT

In a liquid jet recording head having a plurality of discharge ports for discharging liquid therethrough, energy generating elements are provided correspondingly to the discharge ports and generate energy to discharge a liquid. A temperature detecting element for detecting temperature and the energy generating elements are provided on the same support member. The temperature detecting element extends in a direction intersecting a group of the energy generating elements and/or a group of wirings for the energy generating elements.

24 Claims, 13 Drawing Sheets

LIQUID JET RECORDING HEAD INCLUDING A TEMPERATURE SENSOR

This application is a continuation of application Ser. No. 07/885,011 filed May 20, 1992, now abandoned, which is a continuation of application Ser. No. 07/744,654 filed Aug. 9, 1991, now abandoned, which is a continuation of application Ser. No. 07/474,401, filed Feb. 2, 1990, now abandoned.

BACKGROUND OF THE INVENTION

1. Field of the Invention

This invention relates to a liquid injection or liquid jet recording head with a temperature sensor applicable to the printer section of a copying apparatus and the printer section of an image forming output apparatus, a base plate used therein and a recording apparatus provided with them.

2. Related Background Art

In liquid injection recording heads, a construction for temperature-regulating liquid used for recording is known as seen in Japanese Laid-Open Patent Application No. 48-12628. Thus construction is one in which for the purpose of temperature regulation of ink and a single nozzle, a heat conducting plate (spaced apart from the recording head except for a portion thereof) is provided from around the nozzle to an outside heater and a temperature sensor greatly spaced apart from the head is mounted on this plate.

From Japanese Laid-Open Patent Application No. 50-4912, it is known to surround a single nozzle by a heat conducting member, dispose a sensor in a recess formed correspondingly to the nozzle and regulate temperature to 35° C. Any of these is temperature regulation for regulating the temperature of ink so as to provide predetermined viscosity.

Further, from U.S. Pat. No. 4,719,472, it is known to provide a sensor and a heater on the bottom surface of a liquid chamber for supplying ink to a nozzle and preheating the ink.

RELATED BACKGROUND OF THE INVENTION

The above-described prior art, when applied to a plurality of discharge elements, could not stabilize the temperature regulation of the recording head itself because a variation in temperature distribution was caused by the heat generation rate of the discharge elements.

Therefore, a construction which, paying attention to the recording head itself, has been developed by Canon, Inc. particularly for a case where the recording head is provided with a number of (e.g. ten or more) discharge elements as electro-thermal converting members has previously been applied for patent as a very effective invention. This construction can be summarized as follows with reference to FIGS. 13 and 14 of the accompanying drawings.

It is sometimes the case with a recording head using the liquid injection recording system that non-discharge occurs due to various factors such as the solidification of ink and the entry of outside bubbles into the nozzle caused by vibration or high temperature driving of the head. Particularly, in a recording head using a discharge heater, the utilization of heat energy for ink discharge readily makes the head high in temperature. In the ordinary discharge condition, most of the quantity of heat is taken away by discharged ink and the temperature of the head only rises to the order of 50–60° C., but if driving is effected in a state in which the non-discharge due to the above-mentioned factors has occurred, the amount of generated heat of the heater will all be accumulated in the head and the temperature of the head may rise to even 150° C. or higher in some cases to thereby damage the recording head. Particularly where a top plate 30 is formed of resin, the top plate 30 may be deformed at the order of 120° C.

In the aforedescribed prior-art recording head, there is a temperature difference between the vicinity of the discharge heater and the region in which a temperature detecting element is disposed and also, a considerably long transmission time is required and therefore, in some cases, an accurate and quick countermeasure cannot be taken from the relation between response delay and heat capacity, and this has led to the undesirable possibility that the damage of the recording head by the abnormal temperature rise during the above-described non-discharge cannot be prevented.

So, a construction in which on the opposite side portions of a discharge heater arrangement range on a heater board, temperature sensors are formed of the same material as at least a portion of the discharge heater is shown in Japanese Laid-open Patent Application No. 2-258266 of which the assignee is Canon, Inc.

FIG. 13 shows an example of such construction. In this figure, a discharge heater 3' provided on a heater board, two temperature detecting elements (hereinafter referred to as the temperature sensors) 2' disposed on the opposite sides of the arrangement range thereof, wiring 5' of aluminum or the like for supplying electric power thereto, and an electrode pad for providing electrical connection to the outside as by wire bonding are formed on the silicon base plate of the heater board by the film making technique.

According to such a construction, temperature detection excellent in accuracy and responsiveness can be expected because the temperature sensors 2' are disposed near the discharge heater 3'.

However, while this novel construction can obtain an epoch-making effect in a form wherein discharge elements are linearly and highly densely arranged up to the order of one hundred so as to satisfy 300 dpi or 400 dpi recording heads longer than this, for (i.e. example, a recording head of one head full line print type or a recording head having several hundred or more discharge elements) there has been found the tendency that the temperature difference between the discharge element central portion B of the temperature curve of FIG. 13 and the opposite end portions A, C in which the sensors are disposed becomes great as shown. Particularly in the temperature rise during the use of the recording head, the difference in detected temperature has tended to become greater as shown in FIG. 14.

The inventor has considered that this tendency gives rise to a time lag in the temperature rising time of the vicinity (B) of the central portion and the temperature rising time of the opposite ends (A and C) of the heater board 1' and a temperature control system based on the temperature sensors 2' becomes unable to take an accurate and quick countermeasure.

This becomes more remarkable as the heater board 1' is made longer in the direction of arrangement of discharge heaters 3' by arranging a number of discharge heaters 3', for example, arranging several hundred or more discharge heaters or several thousand or more discharge heaters in the full line type. Also, the temperature sensors 2' are disposed on the opposite sides of the arrangement range of the discharge heaters 3' and therefore, it is also conceived that even if an abnormal temperature rise occurs to the discharge heaters when unsatisfactory discharge occurs, the abnormal temperature rise cannot be quickly detected.

SUMMARY OF THE INVENTION

From the above-described new standpoint, the present invention has been developed as an invention which cannot be found at all in the conventional recording heads and moreover has an effect more stabilized than that of the invention of the prior application.

It is an object of the present invention to solve the above-noted problems and to provide a liquid injection recording head which can accomplish temperature detection more excellent in accuracy and responsiveness and which is of more inexpensive construction, and a base plate therefor.

It is another object of the present invention to provide a liquid injection recording apparatus which can accomplish high-speed recording of high image quality by the use of a recording head capable of effecting the above-described stable recording.

It is still another object of the present invention to provide a liquid injection recording head having a plurality of discharge ports for discharging liquid therethrough, heat energy generating elements provided correspondingly to the discharge ports and generating energy available to discharge the liquid, a temperature detecting element for detecting temperature and (a heating element provided as required for heating the liquid) and wherein the energy generating elements, the temperature detecting element and the heating element are provided on one and the same support member and the temperature detecting element extends in a direction intersecting the group of the energy generating elements and/or a group of wirings for the energy generating elements, and a recording apparatus provided with such recording head.

According to the present invention, the temperature detecting element extends in said direction and therefore, it becomes possible to dispose it very proximately to the discharge energy generating elements and also, the error of the detected temperature of the region in which the heating element is disposed is small and accordingly, temperature control excellent in accuracy and responsiveness can be effected.

Still a further aspect of this invention involves a liquid jet recording head having plural discharge ports for discharging liquid therethrough, a support member having a mounting surface and plural liquid paths corresponding to the discharge ports, an array of energy generating elements, corresponding to the liquid paths, provided on the mounting surface of the support member for generating energy to discharge the liquid, a group of wirings for electrically connecting the array of energy generating elements, and a temperature detecting element for detecting temperature, the temperature detecting element being disposed in a vicinity of and at least a part of the temperature detecting element being disposed upstream of each energy generating element with respect to a direction in which liquid is supplied to each energy generating element. The temperature detecting element is provided as a film and extends in a direction of the energy generating element array and overlapping with at least one of the array of energy generating elements and/or the group of wirings. An insulative layer is interposed between the array of energy generating elements and the temperature detecting element, the temperature detecting element being provided on the insulative layer, the array, the insulative layer, and the temperature detecting element being provided in that order from the mounting surface.

Another aspect of this invention is a base plate for a liquid jet recording head, which base plate includes a support member having a mounting surface, an array of energy generating elements, for generating energy to discharge the liquid, a group of wiring portions for electrically connecting the energy generating elements, a temperature detecting element for detecting temperature, the temperature detecting element being disposed in a vicinity of and at least a part of the temperature detecting element being disposed upstream of each energy generating element with respect to a direction in which liquid is supplied to each energy generating element, the temperature detecting element being provided as a film extending in a direction of the energy generating element array and overlapping with at least one of the array of energy generating elements and/or group of wiring portions. An insulative layer is interposed between the array of energy generating elements and the temperature detecting element, the temperature detecting element being provided on the insulative layer, and the array, the insulative layer, and the temperature detecting element is provided in that order from the mounting surface.

Yet another aspect of this invention is a liquid recording head with plural of discharge ports for discharging liquid therethrough, a support member having a mounting surface and plural of liquid paths corresponding to the discharge ports, an array of energy generating elements, corresponding to the liquid paths, provided on the mounting surface of the support member for generating energy to discharge the liquid, a group of wirings for electrically connecting the array of energy generating elements, a temperature detecting element for detecting temperature, the temperature detecting element being disposed in a vicinity of and at least a part of the temperature detecting element being disposed upstream of each energy generating element with respect to a direction in which liquid is supplied to each energy generating element, and an insulative layer interposed between the array of energy generating elements and the temperature detecting element, the temperature detecting element being provided on the insulative layer, the array, the insulative layer, and the temperature detecting element being provided in that order from the mounting surface. A heating element heats the liquid. The temperature detecting element and the heating element are also provided on the mounting surface of the support member and the temperature detecting element and extends in a direction of the energy generating element array and overlapping with at least one of the energy generating elements and/or group of wirings for the energy generating elements.

A further aspect of this invention is a base plate for a liquid jet recording head, which base plate has a support member having a mounting surface, an array of energy generating elements for generating energy to discharge the liquid, a group of wiring portions for electrically connecting the energy generating elements, a temperature detecting element for detecting temperature, the temperature detecting element being disposed in a vicinity of and at least a part of the temperature detecting element being disposed upstream of each energy generating element with respect to a direction in which liquid is supplied to each energy generating element, the temperature detecting element being provided as a film in a direction of the array of energy generating elements and overlapping with at least one of the array of energy generating elements and/or group of wiring portions for the heat energy generating elements. An insulative layer is interposed between the array of energy generating elements and the temperature detecting element, the temperature detecting element is provided on the insulative layer, the array, the insulative layer, and the temperature detecting element is provided in that order from the mounting surface, and a heating element heats the liquid, the heating element also being formed on the support member.

Another aspect of this invention pertains to an ink jet recording apparatus with a liquid jet recording head having plural discharge ports for discharging liquid therethrough, a support member having a mounting surface and plural liquid paths corresponding to the discharge ports, an array of energy generating elements, corresponding to the liquid paths, provided on the mounting surface of the support member for generating energy to discharge the liquid, a group of wirings for electrically connecting the energy generating elements, and a temperature detecting element for detecting temperature. The temperature detecting element is disposed in a vicinity of and at least a part of the temperature detecting element being disposed upstream of each energy generating element with respect to a direction in which liquid is supplied to each energy generating element. The temperature detecting element is provided as a film, the temperature detecting element extends in a direction of the energy generating element array and overlaps with at least one of the array of energy generating elements and/or group of wirings, and an insulative layer is interposed between the array of energy generating elements and the temperature detecting element, the temperature detecting element being provided on the insulative layer, the array, the insulative layer, and the temperature detecting element being provided in that order from the mounting surface. The invention also includes a conveying means for conveying a recording medium opposite to the liquid jet recording head, a recovering means for effecting a recovering process of the recording head, and control means for operating the recovering means in conformity with an output of the temperature detecting element.

This invention also concerns a liquid jet recording apparatus comprising plural of discharge ports for discharging liquid therethrough, a support member having a mounting surface and plural liquid paths corresponding to the discharge ports, an array of energy generating elements, corresponding to the liquid paths, provided on the mounting surface of the support member for generating energy to discharge the liquid, a group of wirings for electrically connecting the array of energy generating elements, a temperature detecting element for detecting temperature, the temperature detecting element being disposed in a vicinity of and at least a part of the temperature detecting element being disposed upstream of each energy generating element with respect to a direction in which liquid is supplied to each energy generating element, the temperature detecting element being provided as a film, and extending in a direction of the energy generating element array and overlapping with at least one of the array of energy generating elements and/or group of wirings. The embodiment also includes an insulative layer interposed between the array of energy generating elements and temperature detecting element, the temperature detecting element being provided on the insulative layer, the array, the insulative layer, and the temperature detecting element being provided in that order from the mounting surface, and conveying means for conveying a recording medium opposite to the discharge ports.

Still a further aspect of this invention is a liquid recording apparatus having plural discharge ports for discharging liquid therethrough, a support member having a mounting surface and plural of liquid paths corresponding to the discharge ports, an array of energy generating elements, corresponding to the liquid paths, provided on the mounting surface of the support member for generating energy to discharge the liquid, a group of wirings for electrically connecting the array of energy generating elements, a heating element, provided on the mounting surface of the support member, for heating the liquid, a temperature detecting element for detecting temperature, the temperature detecting element being disposed in a vicinity of and at least a part of the temperature detecting element being disposed upstream of each energy generating element with respect to a direction in which liquid is supplied to each energy generating element, the temperature detecting element being provided as a film and extending in a direction of the energy generating element array and overlapping with at least one of the energy generating elements and/or said group of wirings. The invention also involves an insulative layer interposed between the array of energy generating elements and the temperature detecting element, the temperature detecting element being provided on the insulative layer, the array, the insulative layer, and the temperature detecting element being provided in that order from the mounting surface, and conveying means for conveying a recording medium opposite to the discharge ports.

Another aspect of the invention concerns a liquid recording apparatus having plural of discharge ports for discharging liquid therethrough, a support member having a mounting surface and plural of liquid paths corresponding to the discharge ports, an array of energy generating elements, corresponding to the liquid paths, provided on the mounting surface of the support member for generating energy to discharge the liquid, a group of wirings for electrically connecting the array of energy generating elements, optionally, a heating element, provided on the mounting surface of the support member, for heating the liquid, a temperature detecting element for detecting temperature, the temperature detecting element being disposed in a vicinity of and at least a part of the temperature detecting element being disposed upstream of each energy generating element with respect to a direction in which liquid is supplied to each energy generating element, the temperature detecting element being provided as a film and extending in a direction of the energy generating element array and overlapping with at least one of the energy generating elements and/or group of wirings. This aspect of the invention also includes an insulative layer interposed between the array of energy generating elements and the temperature detecting element, the temperature detecting element being provided on the insulative layer, the array, the insulative layer, and the temperature detecting element being provided in that order from the mounting surface, and conveying means for conveying a recording medium opposite to the discharge ports, and the temperature detecting film comprises material the thermal conductivity of which varies in response to the temperature and is formed of the same material as material composing a part of the apparatus.

BRIEF DESCRIPTION OF THE DRAWINGS

FIG. 17A is a circuit diagram showing an example of the construction of a circuit for detecting a temperature rise attributable to unsatisfactory discharge or the like.

FIG. 17B is a graph for illustrating the temperature rise attributable to unsatisfactory discharge or the like.

DESCRIPTION OF THE PREFERRED EMBODIMENTS

Some embodiments of the present invention all will hereinafter be described in detail with reference to the drawings.

Figure 1A:
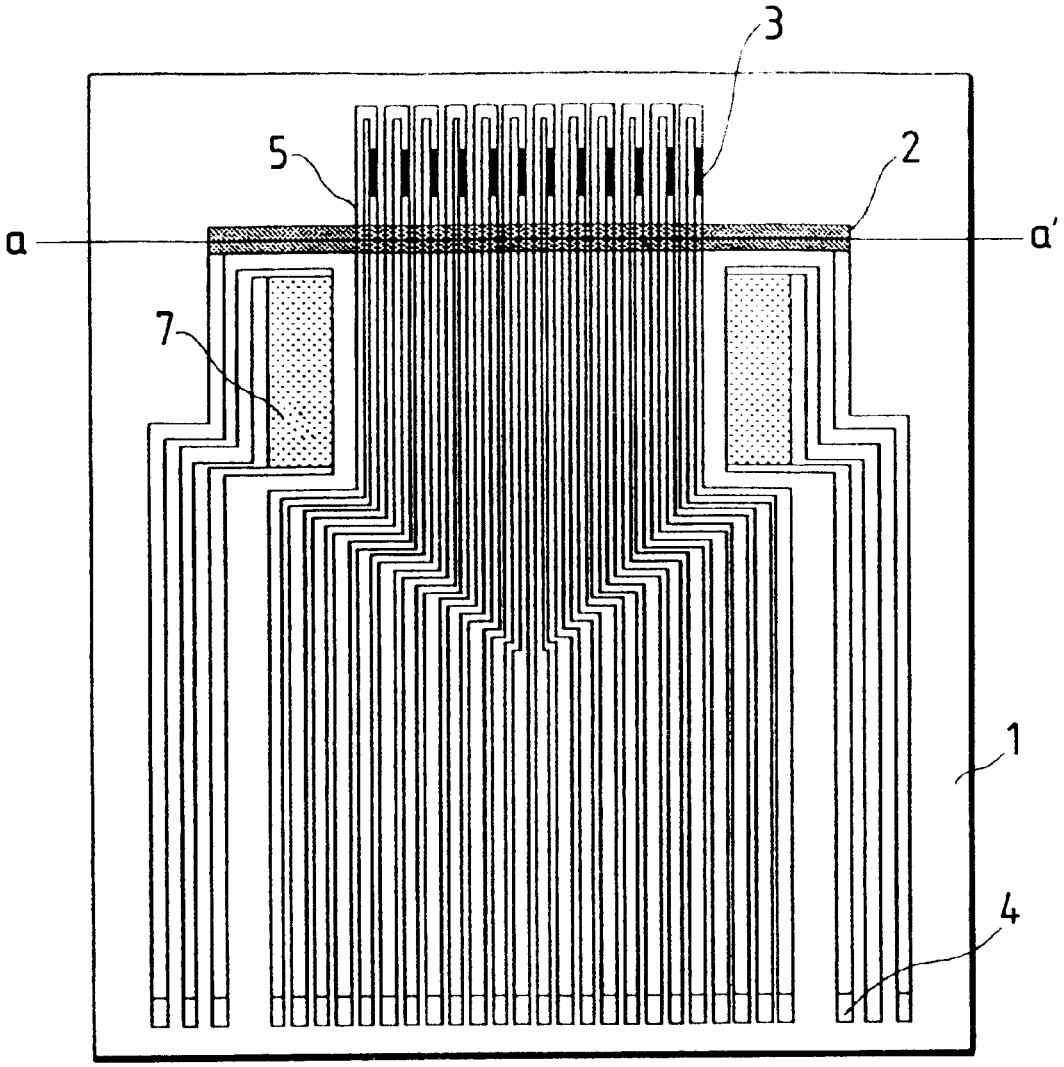
FIGS. 1A and 1B are a plan view and a fragmentary enlarged view, respectively, showing an example of the construction of a heater board applicable to the liquid injection recording head of the present invention.
Figure 1B:
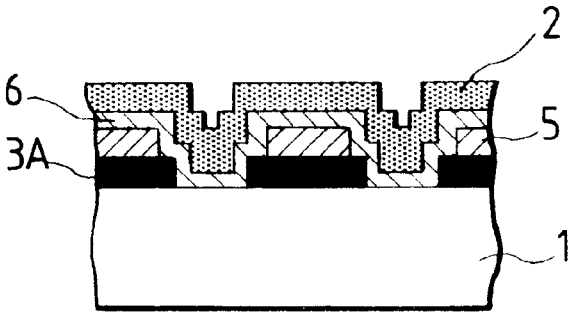
Figure 12:
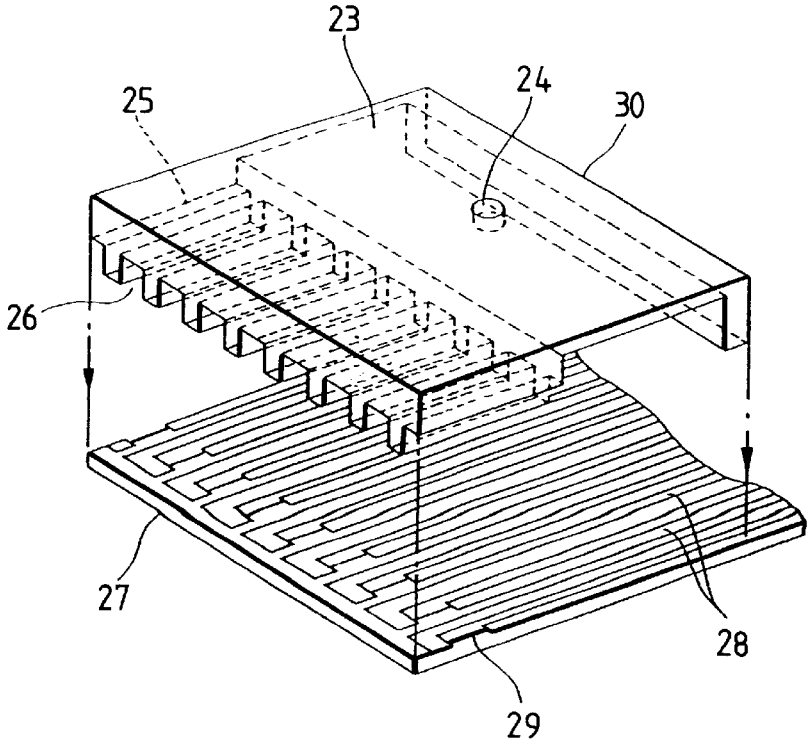
FIG. 12 is a perspective view showing the construction of the top portion of the liquid injection recording head of the present invention.

FIGS. 1A and 1B are a plan view and fragmentary cross-sectional view, respectively, of a heater board according to an embodiment of the liquid injection recording head of the present invention, and specifically, this heater board is applicable to the head construction shown in FIG. 12.

In FIG. 1A, the reference numeral 1 designates a heater board according to the present embodiment, and the reference numeral 3 denotes discharge heaters. The reference numeral 4 designates terminals connected to the outside by wire bonding. The reference numeral 2 denotes a temperature sensor formed on the discharge heaters 3 by the same film making process as that for the discharge heaters 3, etc. FIG. 1B is fragmentary cross-sectional view of a portion a–a' including the sensor 2 in FIG. 1A. The reference character 3A designates layers for forming the discharge heaters 3 (heat generating resistance layers.) The layers 3A are provided as the lower layer of wiring 5 except for the portions of the discharge heaters 3. The reference numeral 6 denotes a layer for insulating the layer forming the temperature sensor 2, the layers 3A and the layer forming the wiring 5. The reference numeral 7 designates a heat insulation heaters for heating the head.

The temperature sensor 2 like the other portions, is formed by a film making process similar to that for semiconductor and therefore is of very high accuracy, and can be made of a material whose electrical conductivity varies in conformity with temperature, such as aluminum, titanium, tantalum, tantalum pentoxide or niobium which is the material forming the other portions. For example, of these materials, aluminum is a material which can be used for an electrode, titanium is a material which can be disposed between the heat generating resistance layer forming an electro-thermal conversion element and the electrode to enhance the adhesiveness of the heat generating resistance layer and the electrode, and tantalum is a material which can be disposed on the upper portion of a protective layer on the heat generating resistance layer to enhance the anti-cavitation property thereof. Also, in order to reduce the irregularity of the process, the line width is made great, and in order to reduce the influence of wiring resistance or the like, a zigzag shape is adopted to thereby achieve higher resistance.

Also, the heat insulation heater 7 can be formed of the same material as the heat generating resistance layers of the discharge heaters 3 (for example, $HfB_2$), but may be formed of other material forming the heater board, for example, aluminum, tantalum, titanium, niobium or the like.

FIG. 12 shows an example of the construction of a recording head of this kind. The reference numeral 27 designates a base plate (a heater board). On a support member of silicon or the like, electro-thermal converting members (discharge heaters) 29 and wiring 28 of aluminum or the like for supplying electric power thereto are formed by the film making technique. A top plate 30 provided with partition walls for limiting liquid paths 25 is adhesively secured to the heater board 27, whereby a liquid injection recording head is constructed.

Liquid (ink) for recording is supplied to a common liquid chamber 23 from a supply port 24 formed in the top plate 30, and is directed thence to each liquid path 25. When the heaters 29 generate heat by electrical energization, bubbles are produced in the ink filling the liquid paths 25 and thus, ink droplets are discharged from discharge ports 26.

Figure 2:
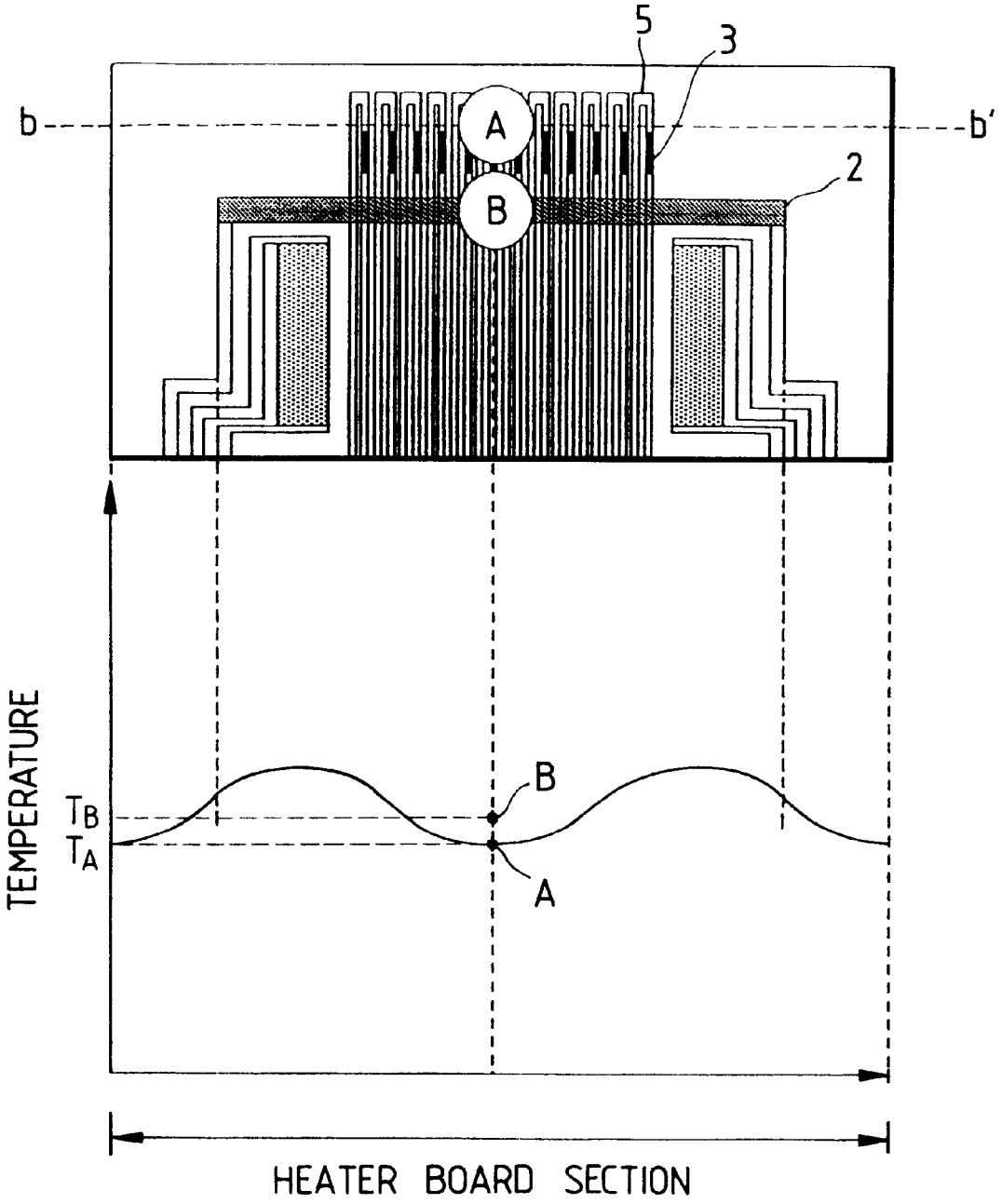
FIGS. 2 and 3 illustrate the temperature distribution and the temperature rise characteristic, respectively, on heater board shown in FIG. 1.
Figure 3:
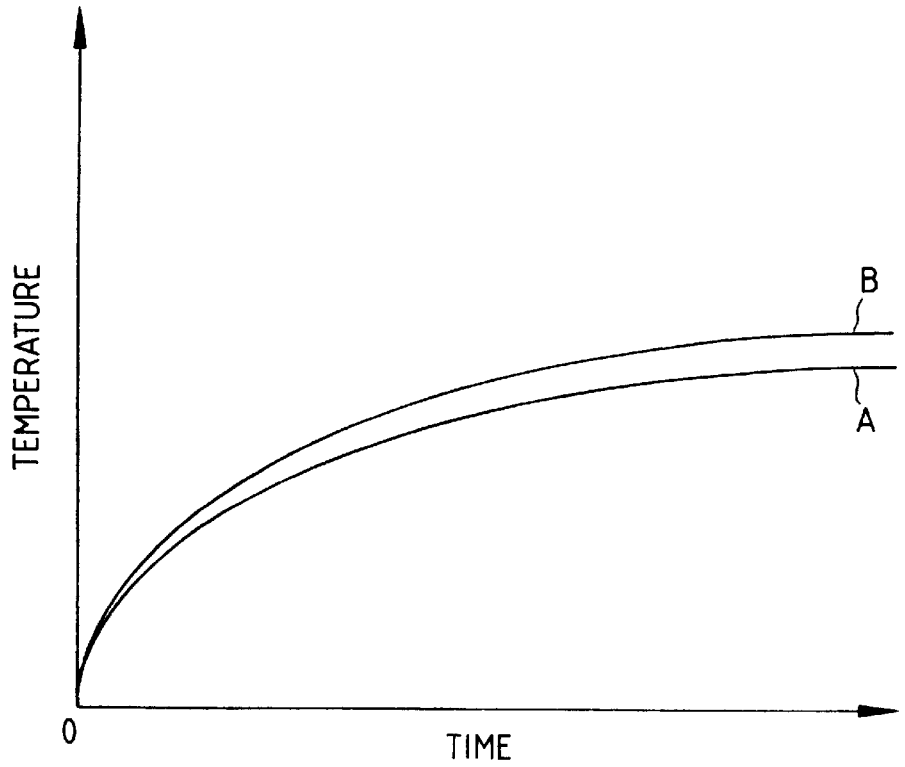
Figure 13:
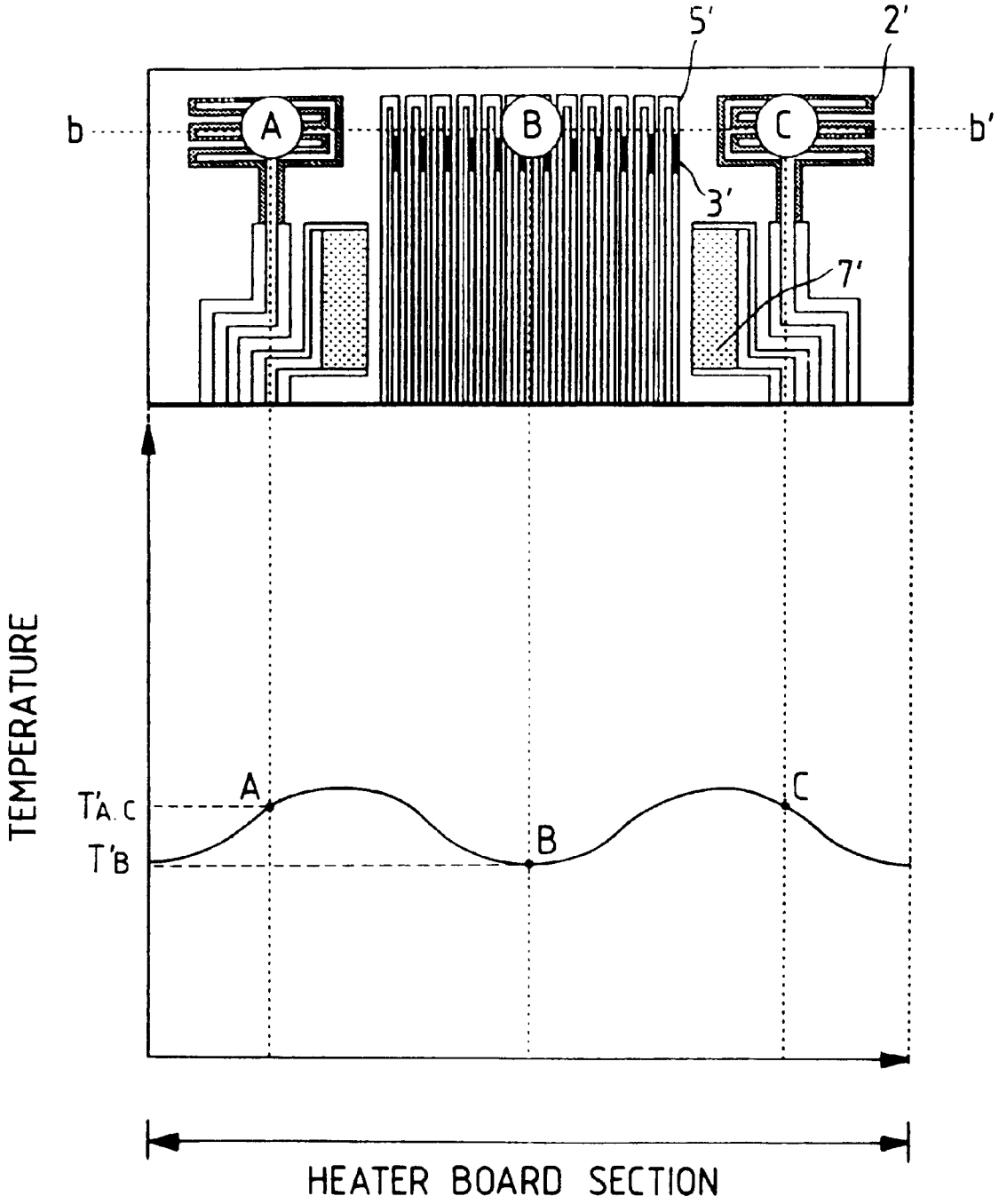
FIG. 13 PRIOR ART
FIG. 13 is an illustration showing the construction of the essential portions of the prior invention of the assignee of the present invention which is the background art of the present invention and also showing the temperature distribution in the developed construction thereof.
Figure 14:
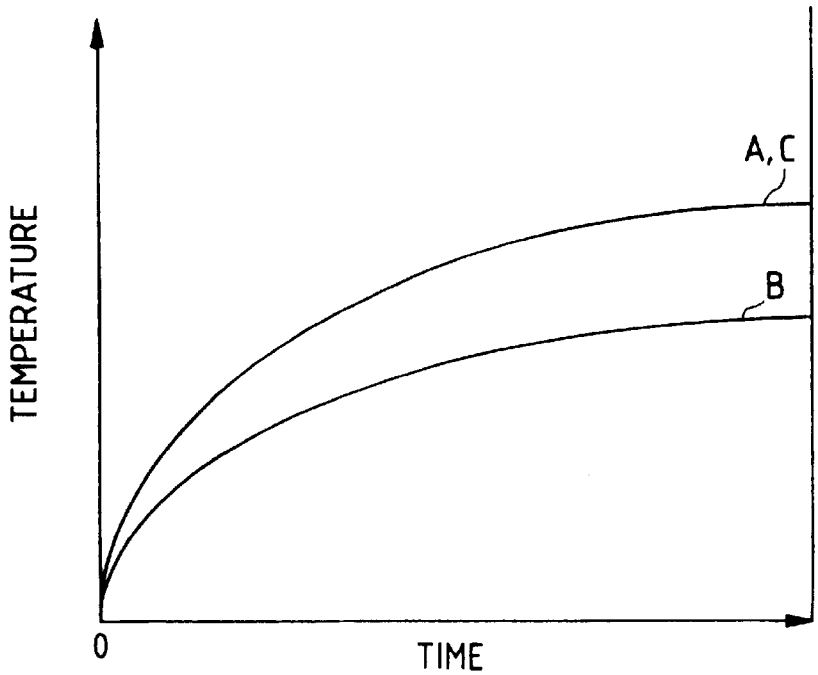
FIG. 14 PRIOR ART
FIG. 14 is a graph illustrating the temperature rise characteristic of the temperature of FIG. 13 to time.

FIG. 2 shows the temperature distribution (solid line) in a portion b–b' on the heater board 1 according to the present embodiment when the heat insulation heaters 7 on the opposite sides are driven. $T_A$ indicates the temperature of a portion A, and $T_B$ indicates the temperature of a portion B obtained on the basis of the detection output of the temperature sensor 2. FIG. 3 shows variations with time in the temperatures of the portion A in the portion b–b' and the portion B in the temperature sensor portion. From these, it has been confirmed that temperature information detected by the temperature sensor 2 according to the present embodiment has a laser error than the afore-described excellent invention (shown in FIGS. 13 and 14) and is good in responsiveness.

Figure 4:
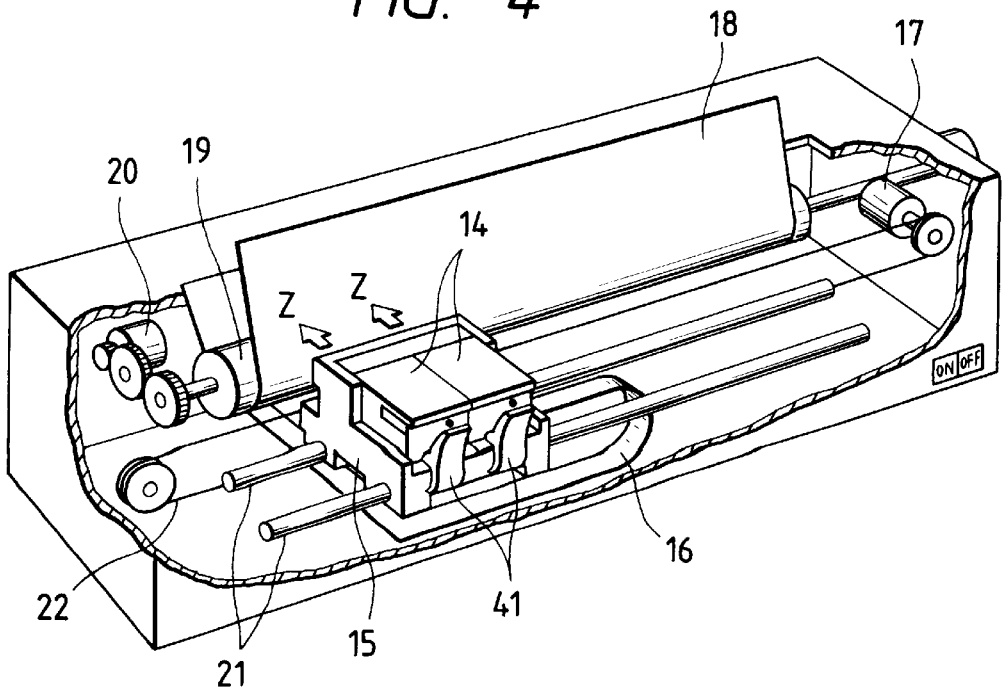
FIG. 4 is a perspective view schematically showing an example of the construction of a liquid injection recording apparatus to which the present invention is applied.

The heater board of such a construction can be used instead of the heater board 27 of FIG. 12 to construct a recording head, and further, such recording head can be used to construct a liquid injection recording apparatus (an ink jet recording apparatus) as shown in FIG. 4.

In FIG. 4, the reference numeral 14 designates head cartridges in each of which a recording head constructed by the use of a heater board 1 like that of the present embodiment and an ink tank which is an ink supply source are made into a unit. These head cartridges 14 are fixed on a carriage 15 by keep members 41, and these are reciprocally movable in the lengthwise direction along shafts 21. Ink discharged from the recording head arrives at a recording medium 18 having its recording surface controlled by a platen 19 with a slight spacing kept with respect to the recording head, and forms an image on the recording medium 18.

The recording head is supplied with a discharge signal conforming to image data from a suitable data supply source through a cable 16 and terminals 4 (FIG. 1) coupled thereto. The number of head cartridges provided may be one or more (in FIG. 4, two) in conformity with ink colors used or the like.

Further, in FIG. 4, the reference numeral 17 denotes a carriage motor for causing the carriage 15 to scan along the shafts 21, and the reference numeral 22 designates a wire for transmitting the drive force of the motor 17 to the carriage 15. The reference numeral 20 denotes a feed motor coupled to the platen roller 19 to convey the recording medium 18.

Figure 5:
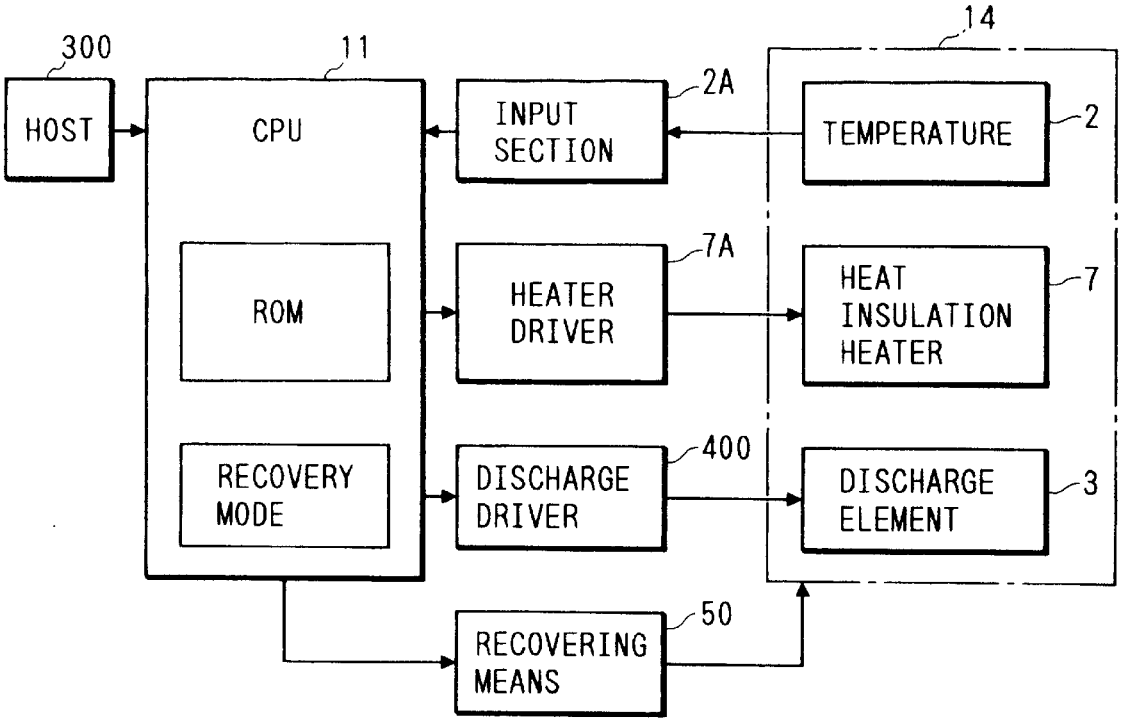
FIG. 5 a block diagram showing an example of the construction a control system shown in FIG. 4.

FIG. 5 shows an example of a temperature control system using the detection output of the sensor 2 of FIG. 1 and the output of the heat insulation heaters 7. Various portions coupled to the sensor 2 and the heaters 7 can be provided on the control board or the like of the apparatus and can be connected from the terminals 4 through the cable 16.

The reference numeral 11 designates a CPU in the form of a microcomputer for executing the processing procedure which will be described later with reference to FIG. 6. The CPU 11 has an ROM storing therein fixed data such as a program corresponding to that processing procedure. This CPU 11 can also be provided to independently execute the temperature control according to the present embodiment, or may be used also as the main control unit of the apparatus shown in FIG. 4.

The reference character 2A denotes an input section for supplying electric power to the temperature sensor 2 and taking out the detected value, and converting it into a signal fit for the CPU 11. The reference character 7A designates a heater driver for electrically energizing the heat insulation heater 7.

Figure 6:
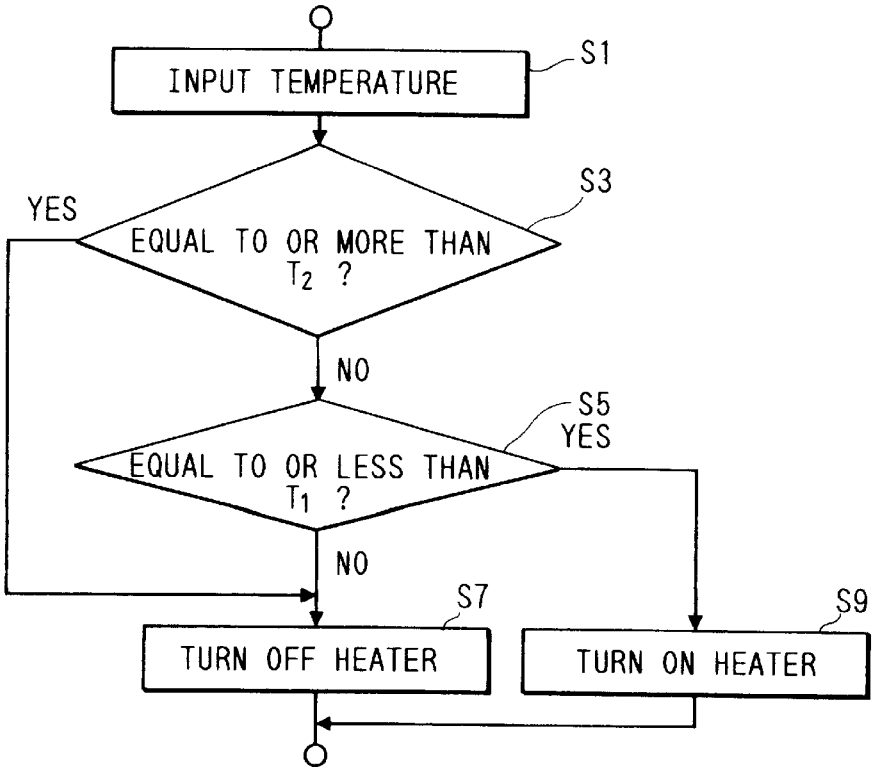
FIG. 6 is a flow chart showing an example of the temperature control procedure according to FIG. 4.
Figure 7:
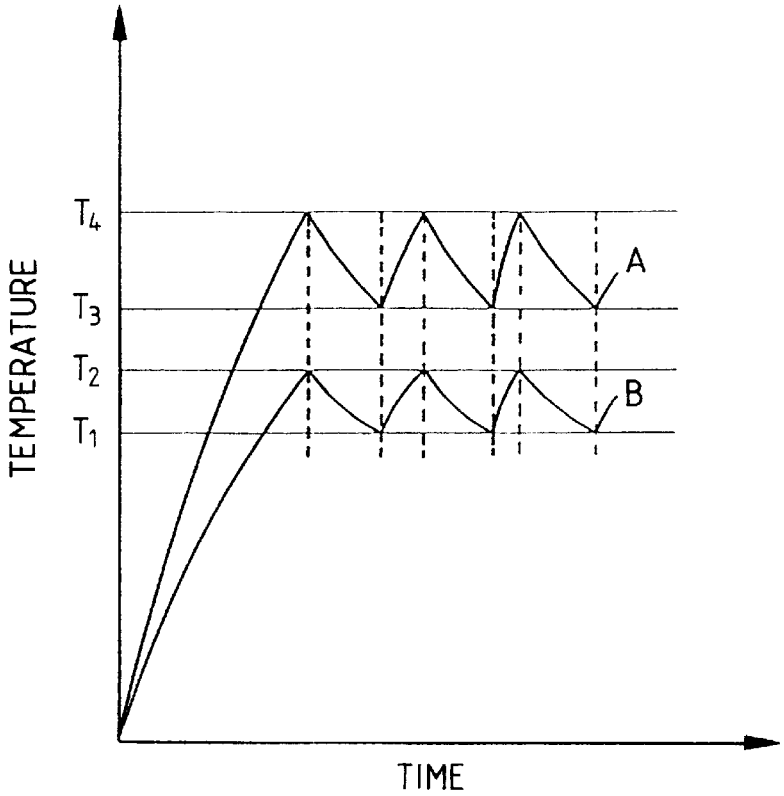
FIG. 7 is a graph for illustrating the operation of the FIG. 4 apparatus.

FIG. 6 shows an example of the temperature control procedure according to the present embodiment, and FIG. 7 shows a mode of the temperature control according to the present embodiment. In these figures $T_1$–$T_4$ indicate temperature, and it is to be understood that in the present embodiment, the temperature of the portion A of FIG. 2 is set to the range of $T_3$–$T_4$. Therefore, the heat insulation heaters 7 are controlled so that the temperature of the portion B of FIG. 2 may be set to the temperature range $T_{1-T2}$.

The procedure shown in FIG. 6 can be started at suitable timing, and when this procedure is started, the output of the sensor 2 is first read at step S1, and at step S3, whether the temperature is equal to or more than $T_2$ is judged. If negative judgement is done, advance is made to step S5, where whether the detected. temperature of the sensor 2 is equal to or less than $T_1$ is judged.

If negative judgement is done at the step S5 or if affirmative judgement is done at the step S3, the heater 7 is turned off at step S7, and if affirmative judgment is done at the step S5, the heater 7 is turned on at step S9.

In the ink jet recording system according to the present embodiment, the variation in the discharge characteristic by temperature is great, and it stabilizes the discharge characteristic and makes the quality of recording good to approximate particularly the temperature of the nozzle portion (the portion A in FIG. 2) to a predetermined level. If the temperature is measured by the temperature sensor 2 disposed as in the present embodiment so that when the temperature reaches $T_2$, the heat insulation heater 7 may be turned off and when the temperature falls to $T_1$, the heat insulation heater 7 may be turned on, the variation in the temperature of the portion A can be kept within the range of $T_3$–$T_4$. Thus, according to the present embodiment, the heat insulation heaters and the temperature sensor are disposed on one and the same heater board and moreover, the detected temperature is averaged and therefore, the error of the detected temperature values of the region in which the heat insulation layers are disposed and the central portion of the discharge heater arrangement range is small and the accuracy of temperature control is greatly improved.

In FIG. 5, the CPU 11 has a mode for performing the recovering operation by recovering means 50 capable of effecting the recovery mode well known in ink jet recording apparatuses (sucking the ink from the discharge ports by a suction port, or discharging the ink from the ink supply side by the pressing by a pressing pump, or effecting ink discharge called preliminary discharge or idle discharge toward a cap or an ink absorbing member, instead of supplying a recording signal to a discharge element, or in addition thereto or simply slidingly cleaning the surface of the recording head). The reference numeral 400 designates a discharge driver which receives a signal from a recording signal producing host 300 such as the body of a reading sensor, a memory or the like and drives the discharge element 3 for recording. The recovery mode is effected when an abnormal temperature rise during temperature regulation is detected as will be described with reference to FIG. 20 and besides, is effected for the initial stabilization in the general sequence or for the stabilization during recording.

The positioning of the recording head 14 and the carriage and the connection of contacts are well known in the art and therefore need not be described in detail.

FIGS. 8 to 11 show further examples of the contruction of the heater board 1. In these figures, portions similar to those in FIG. 1 are given similar reference numerals.

Figure 8:
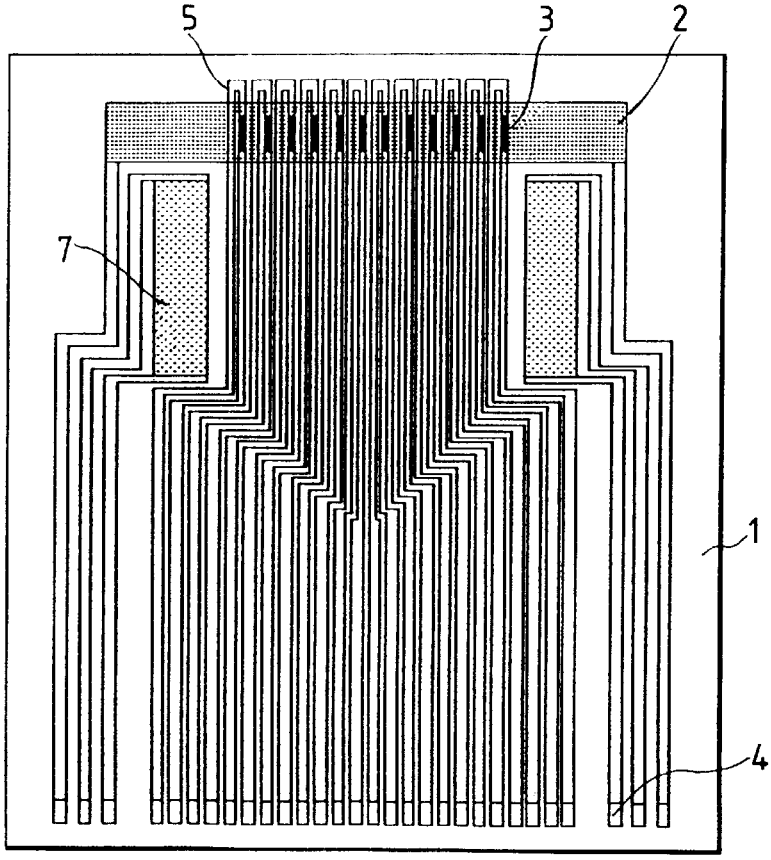
FIGS. 8 to 11 are plan views showing four other examples of the construction of the heater board according to the present invention.

The heater board shown in FIG. 8 disposed as the upper layer of the temperature sensor 2 and discharge heaters 3 so that the arrangement range of the temperature sensor 2 and discharge heaters 3 may be completely included therein, and is more improved in the accuracy temperature detection or temperature control and responsiveness. Also, in FIGS. 9–11, the temperature sensor 2 is formed into a zigzag shape to reduce the influence of wiring or the like, thereby achieving higher resistance. As shown in these figures, the pattern of the temperature sensor 2 may be determined as desired. Also, the temperature sensor 2 may be provided as the upper layer or the lower layer of the discharge heaters or the wiring 5 in conformity with the material chosen to form the temperature sensor.

Figure 9:
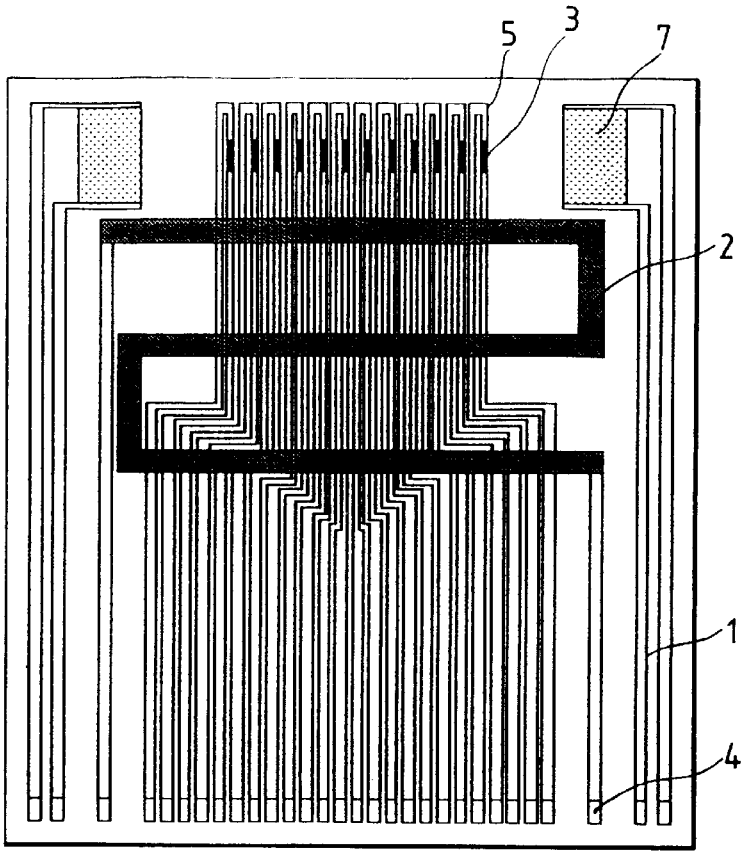
Figure 10:
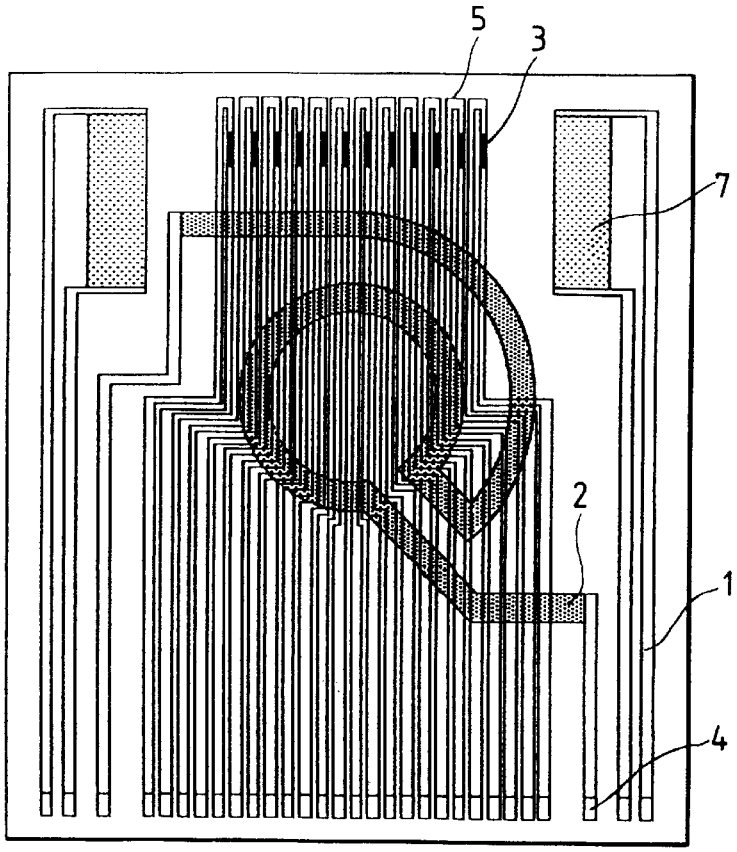
Figure 11:
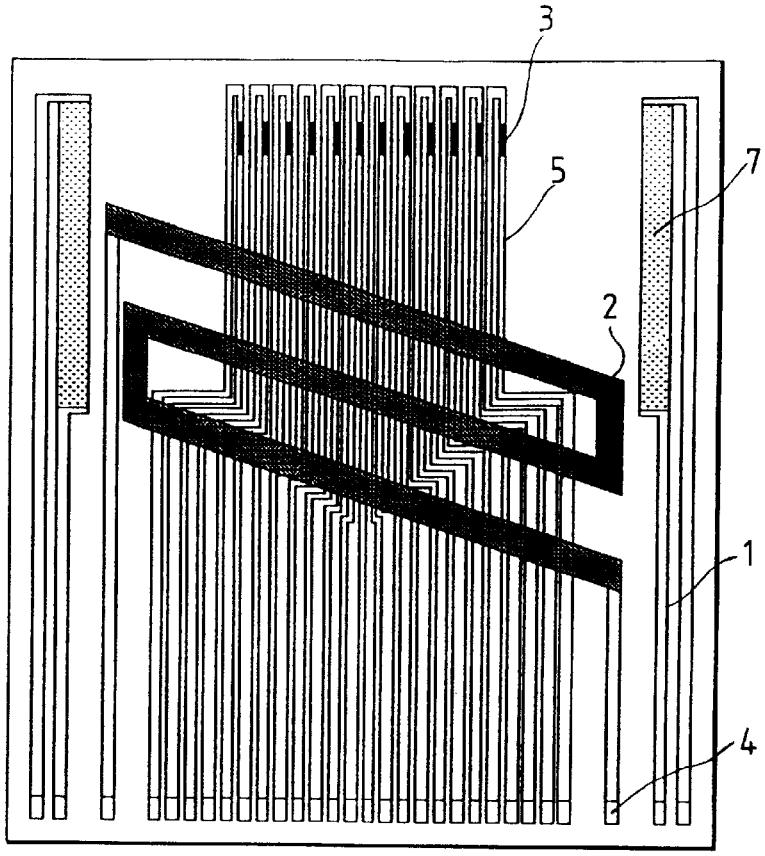

In FIG. 9, the temperature sensor crosses the direction of arrangement of discharge elements a plurality of times and thus, even if the area of partial temperature rise increases, plural times of data supply is effected to the sensor and therefore, the real temperature distribution of the recording head can be detected more accurately. Also, in FIG. 10, the detecting area of the sensor is set so as to detect a plurality of times even the temperature of the other area than the area in which the influence of the heat insulation heaters 7 is greater than that of the entire discharge heater and therefore, more uniformized accurate temperature detection is achieved. In FIG. 11, both of the temperature detection of the heat-acting area of the discharge elements and the temperature detection of the interior of the common liquid chamber can be used as detection data and therefore, the temperature of the entire recording head and a variation therein can be detected. According to FIG. 11, preferable control of the recording head as it is used for a long period of time can be appropriately introduced.

In the above-described embodiment, the sensor 2 may be a diode, a transistor or the like if it can be formed by the film making process for the heater board.

Also, the foregoing description has been made of a case where the present invention is applied to a recording head used in a serial printer, but of course, the present invention can also be applied very effectively and readily to a so-called full multitype recording head used in a line printer in which discharge ports are aligned correspondingly to the full width of a recording medium, because such a recording head is made long by a number of discharge heaters being arranged.

Further, the shape of the temperature sensor and the region of arrangement and number of the heaters can of course be determined on the heater board as desired.

As described above, according to the present embodiment, the temperature detecting sensor and the heat insulation heaters are directly made integral with the heater board and the sensor is made to extend in a direction intersecting the group of discharge heaters and/or the group of wiring portions for the discharge heaters, whereby the temperature error and the detection delay become very small and therefore, temperature control can be effected highly accurately and quickly. Thereby, the problem of deteriorated quality of recording which arises when temperature control is inappropriate can be solved.

Also, the material used in the film making process for the heater board can be intactly used for the temperature sensor and the heat insulation heaters, and if the pattern of the film making is changed, they can be manufactured easily and therefore the manufacturing cost thereof can be greatly reduced as compared with the prior art.

Further, the manufacturing cost can be more reduced as compared with a case where with the balance of temperature detection taken into consideration, temperature sensors are disposed on the opposite sides of the discharge heater arrangement range and temperature detecting systems are provided respectively.

Figure 15:
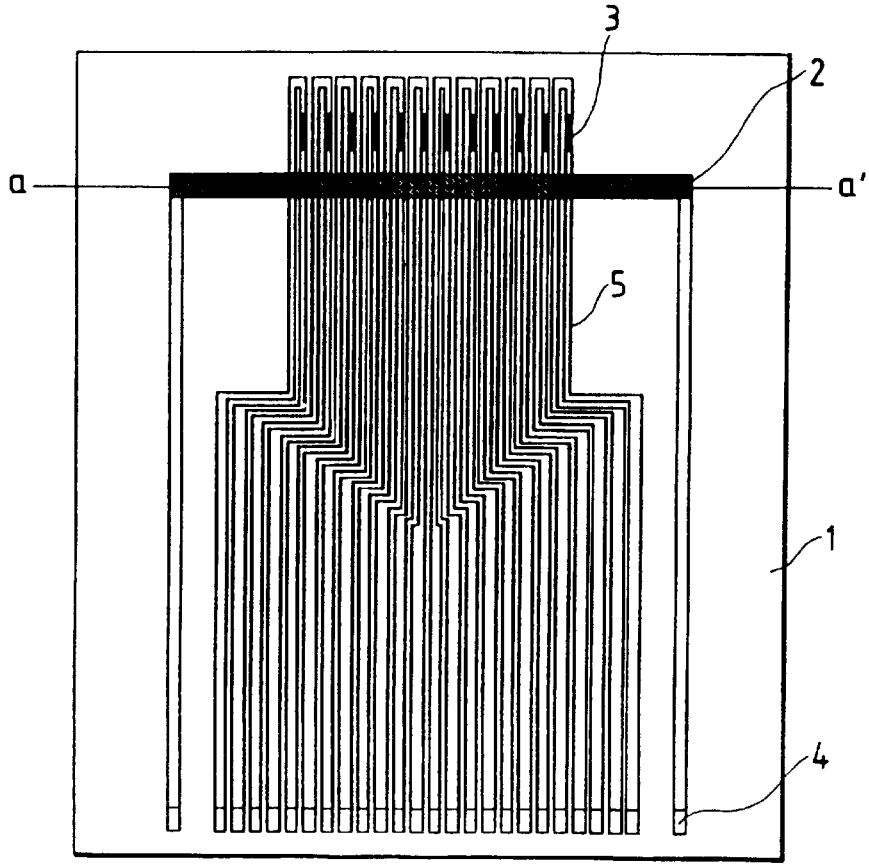
FIG. 15 is a plan view of a modification of the FIG. 1 embodiment and showing an example of the construction of a heater board having no heating element applicable to the liquid injection recording head of the present invention.
Figure 16:
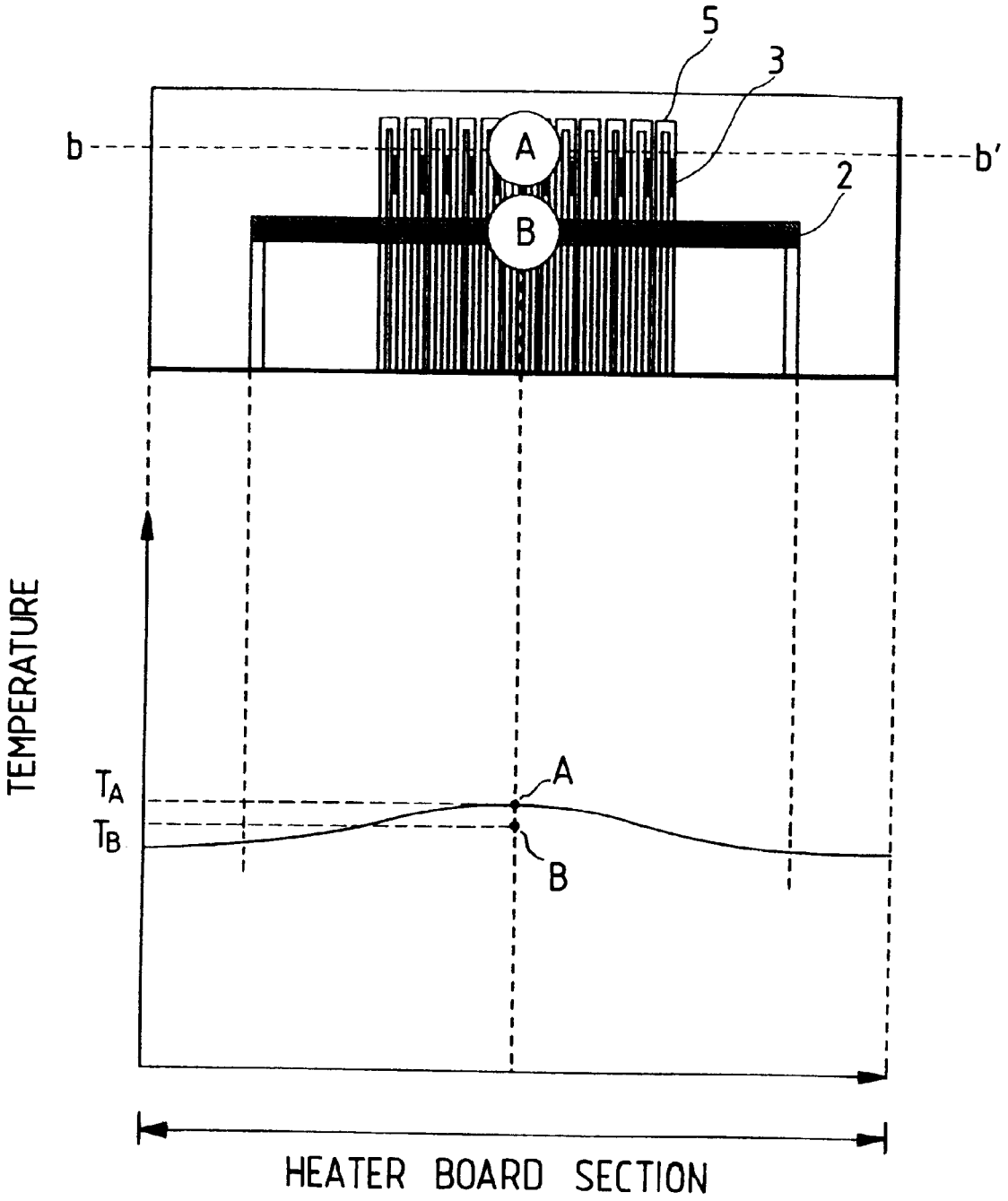
FIG. 16 illustrates the temperature distribution on the heater board shown in FIG. 15.

Reference is now had to FIGS. 15 and 16 to describe an embodiment in which the present invention is applied to a head of a construction, in which the heat insulation heaters 7 of the above-described embodiments are eliminated and a base plate therefor. This construction excludes the heat insulation heaters 7, and the present embodiment includes the constructions shown in FIGS. 1A and 1B, 8, 9, 10 and 11, and the advantages of the shapes of the sensor shown in FIGS. 8 to 11 hold true as they are. However, in the absence of the heat insulation heaters, a reduction in the temperature of the opposite ends will be seen from the relation of heat emission, but in the present embodiment, the influence of this problem is eliminated and the detection of the temperature of the entire head becomes possible, thus resulting is an excellent detecting property.

FIG. 16 shows the temperature distribution (solid line) of the portion b–b' on the heater board 1 according to FIG. 16 when the discharge heaters 3 are driven. $T_A$ indicates the temperature of the portion A, and $T_B$ indicates the temperature of the portion B obtained on the basis of the detection output of the temperature sensor 2. Also, the variation with time in this embodiment is such that the curve B in the present embodiment corresponds to the curve A in FIG. 3 and the A in the present embodiment corresponds to the curve B in FIG. 3, and temperature detection similar to that shown in FIGS. 1 and 2 has been achieved.

In the embodiment of FIG. 1, the upper limit side of the recording head embodied is seen, whereas in the present embodiment, the lower limit side is seen, but since the error of temperature detection is small, both embodiments can obtain an effective detection result. In any case, it has been confirmed that the present embodiment is smaller in error and better in responsiveness than the prior invention of FIG. 13 and 14.

The present embodiment is likewise applied to the apparatus and head of FIGS. 4 and 12.

Figure 17A:
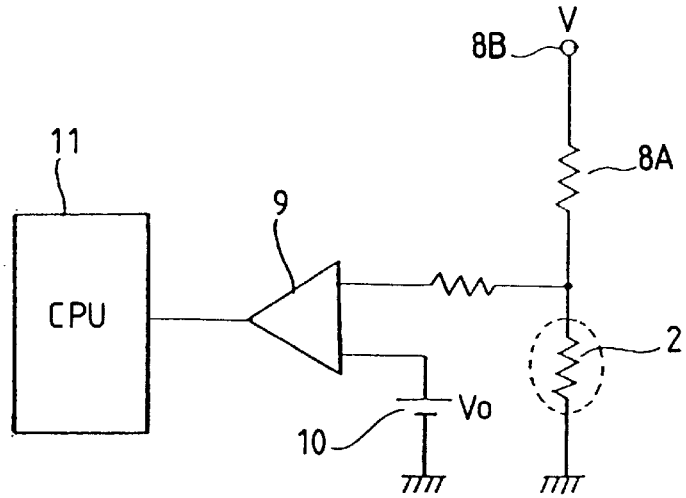

FIG. 17A shows an example of a temperature detecting section using the temperature sensor 2 of FIG. 15. Various portions coupled to the sensor 2 can be provided on the control board or the like of the apparatus, and can be connected from the terminals 4 through the cable 16.

As shown, a voltage dividing resistor 8A and a voltage terminal 8B are connected to the temperature sensor 2, and a variation in the resistance of the sensor 2 is converted into a voltage. The voltage-converted output is compared with a reference voltage source 10 by a comparator 9, and is input to the CPU 11 which forms the main control unit of the apparatus shown in FIG. 5. That is, the CPU 11 can judge whether the temperature of the heater board is above or below a certain set value.

Figure 17B:
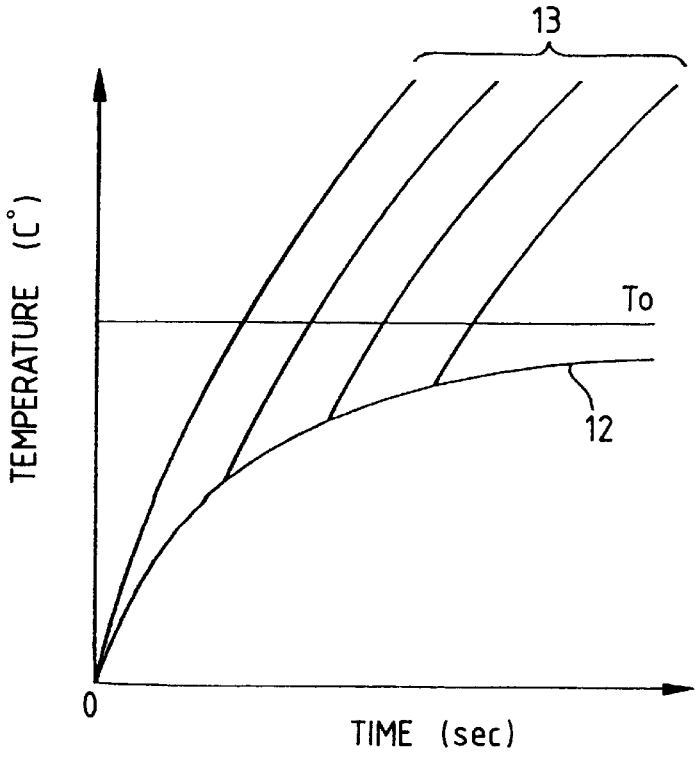

The variation in the temperature of the sensor portion of the heater board 1 is such as shown in FIG. 17B. That is, during normal discharge of the ink, the temperature varies transiently as indicated by curve 12 and reaches the steady state at a certain level, but if clogging or other unsatisfactory ink discharge occurs, the quantity of heat will be accumulated and the temperature will begin to rise suddenly. Curve 13 indicates the variation in the temperature during the unsatisfactory ink discharge condition.

Accordingly, if the reference voltage $V_O$ is set so that the output of the comparator 9 is inverted at a temperature $T_O$ when the temperature of the heater board 1 exceeds $T_O$, this is communicated to the CPU 11, whereby the CPU 11 can judge that unsatisfactory ink discharge has occurred, and can discontinue the discharge and produce an alarm and further, can start the recovering operation cooperative with a cap device or the like. $T_O$ may be equal to or less than a temperature which is not reached in the ordinary ink discharge condition and at which the head is destroyed.

Figure 18A:
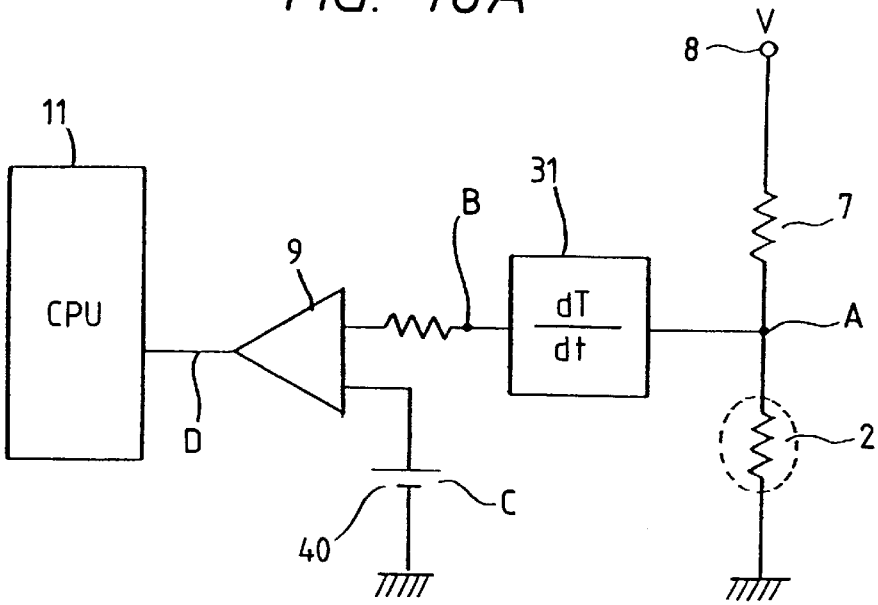
FIGS. 18A and 18B are illustrations of another example for illustrating the operation of a group of embodiments represented by FIG. 15.
Figure 18B:
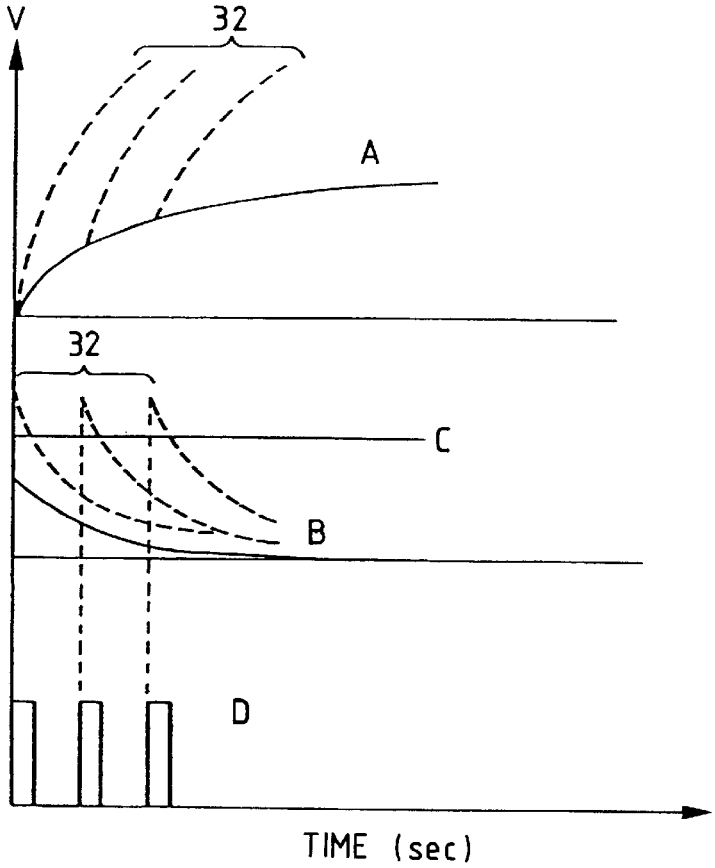

FIG. 18A shows an embodiment in which a differentiator 31 is provided at the preceding stage of the comparator 9 of the circuit shown in FIG. 17A so that the rate of variation of the temperature sensor 2 may be monitored. FIG. 18B shows the output waveforms of the portions A–D of FIG. 18A.

The temperature sensor output A begins to vary suddenly when non-discharge condition occurs. This rate of variation appears at a voltage level at the output B of the differentiator 31, and the CPU 11 is informed by the comparison with the output C of the reference voltage 10 that non-discharge has begun. The CPU 11 can start the aforedescribed suitable processing in conformity with this information.

According to the present embodiment, any variation in temperature is monitored and therefore, even if the heater board 1 does not reach a certain degree of high temperature, non-discharge condition can be detected immediately when it occurs, and the influence of the environmental temperature is small and the head can be protected more effectively.

Figure 19:
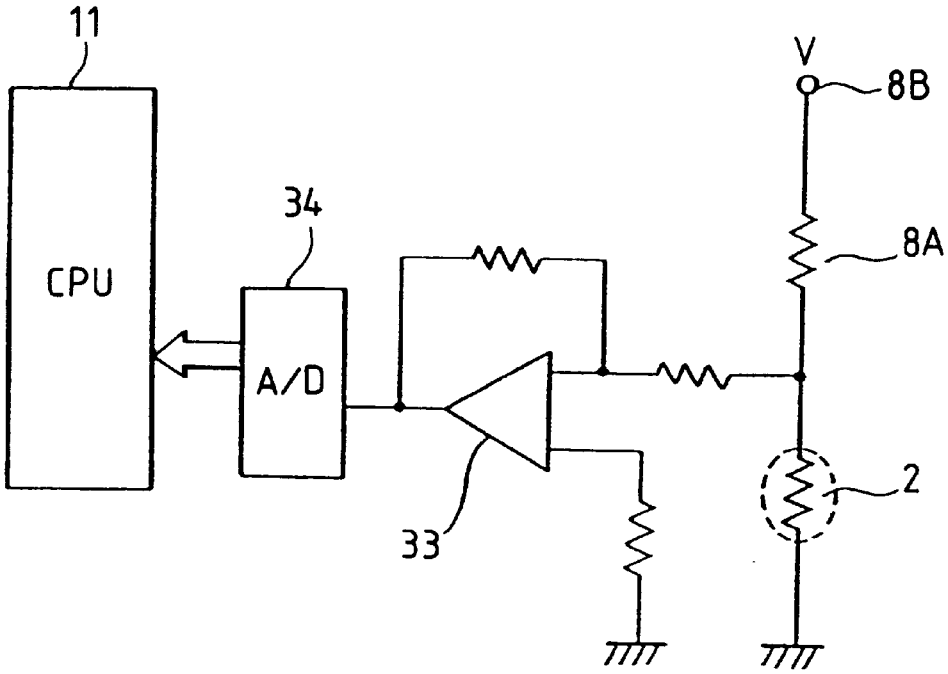
FIG. 19 is a circuit diagram showing still another example of the construction of the temperature rise detecting circuit.

FIG. 19 shows a third embodiment of the control system of the present invention in which the rate of variation in the temperature of the heater board 1 may be detected by software with the aid of the processing by the CPU 11. The output of the temperature sensor 2 is amplified by an operational amplifier 33 and input to an A/D converter 34, and a temperature value digitalized therein is input to the CPU 11.

Figure 20:
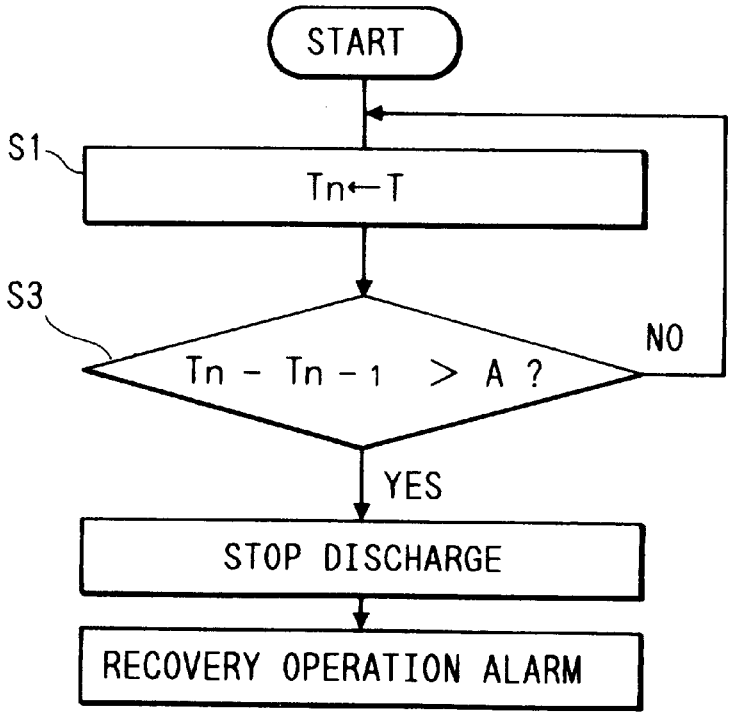
FIG. 20 is a flow chart showing an example of the abnormality discriminating process procedure based on the detection by the FIG. 19 circuit.

The CPU 11 executes the judgment sequence exemplarily shown in FIG. 20, and judges non-discharge by seeing the difference between the temperature value $T_n$ read at that point of time (step S1) and the last temperature value $T_{n-1}$ (step S3).

That is, it judges whether $T_n - T_{n-1}$ is equal to or greater than a predetermined value A. If the judgment is affirmative, non-discharge is judged and immediately the discharge operation is discontinued (step S5) and further, the recovery operation, an alarm, etc. can be effected (step S7).

In the present embodiment, as compared with the first embodiment, the time delay by the comparison between two points is great, but the set temperature A can be determined by software as desired and therefore, even when the discharge duty is low and the amount of variation in temperature is small, detection corresponding to the discharge duty can be accomplished. That is, a flexible countermeasure conforming to the condition of use of the recording head, etc. is possible.

As described above, according to the present invention, the temperature detecting sensor is directly made integral with the heater board and the sensor is made to extend in a direction intersecting the group of discharge heaters and/or the group of wiring portions for the discharge heaters, whereby the temperature error and the detection delay become very small and therefore, the occurrence of temperature rise factors such as unsatisfactory discharge can be judged highly accurately and quickly and the damage of the recording head can be obviated.

The present invention brings about an excellent effect particularly in recording heads and recording apparatuses of the bubble jet type among the ink jet recording systems, because bubble formation is readily affected by the temperature of the electro-thermal converting member side of the recording head base plate, in addition to the temperature of liquid, and therefore the excellent temperature detection of the present invention becomes very effective.

As regards the typical construction and principle thereof, it is preferable to practice by the use of the basic principle disclosed, for example, in U.S. Pat. No. 4,723,129 and U.S. Pat. No. 4,740,796. This system is applicable to both of the so-called on-demand type and the so-called continuous type, and particularly in the case of the on-demand type, at least one driving signal corresponding to recording information and providing a rapid temperature rise which exceeds nuclear boiling is applied to electro-thermal converting members disposed correspondingly to a sheet on which liquid (ink) is retained and liquid paths, thereby causing the electro-thermal converting members to generate heat energy and causing film boiling on the heat-acting surface of the recording head with a result that a bubble in the liquid (ink) corresponding at one to one to this driving signal can be formed, and this is effective. By the growth and contraction of this bubble, the liquid (ink) is discharged through a discharge opening to thereby form at least one droplet. If this driving signal is formed into a pulse shape, the growth and contraction of the bubble takes place appropriately on the spot and therefore, discharge of the liquid (ink) particularly excellent in responsiveness can be achieved, and this is more preferable. The driving signal of such pulse shape may suitably be one described in U.S. Pat. No. 4,463,359 or U.S. Pat. No. 4,345,262. More excellent recording can be accomplished if the conditions described in U.S. Pat. No. 4,313,124 which is an invention relating to the rate of temperature rise of the above-mentioned heat-acting surface are adopted.

As regards the construction of the recording head, besides the combination of discharge ports, liquid paths and electro-thermal converting members as disclosed in each of the above-mentioned patents (rectilinear liquid flow paths or perpendicular liquid flow paths), the constructions using U.S. Pat. No. 4,558,333 and U.S. Pat. No. 4,459,600 which disclose constructions in which the heat-acting portion is disposed in a crooked area are converted by the present invention. In addition, the present invention is also effective for constructions based on Japanese Laid-Open Pat. Application No. 59-123670 which discloses a construction in which a slit common to a plurality of electro-thermal converting members is the discharge portion of the electro-thermal converting members and Japanese Laid-Open Pat. Application No. 59-138461 which discloses a construction in which an opening for absorbing the pressure wave of heat energy corresponds to a discharge portion.

Further, a recording head of the full line type having a length corresponding to the width of a maximum recording medium on which the recording apparatus can effect recording may adopt any of the constructions as disclosed in the above-mentioned patents and patent applications wherein a combination of a plurality of recording heads satisfies that length and the constructions as a single recording head formed as a unit, and the present invention can display the above-described effect more effectively. In addition, the present invention is also effective for a case where use is made of a recording head of the interchangeable chip type which is mounted on an apparatus body, whereby the electrical connection to the apparatus body and the supply of ink from the apparatus body become possible, or a recording head of the cartridge type in which a cartridge is provided integrally with the recording head itself.

Also, the addition of recovering means, preliminary auxiliary means, etc. for the recording head which are provided in the construction of the recording apparatus of the present invention can further stabilize the effect of the present invention and is therefore preferable. Specifically mentioning these, they are capping means, cleaning means and pressing or suction means for the recording head, and preheating means by an electro-thermal converting member or a heating element discrete therefrom or a combination of these, and a preliminary discharge mode in which discharge discrete from recording is effected is effective for accomplishing stable recording. Further, the recording mode of the recording apparatus is not limited to a recording mode by the main color such as black, but may also be provided by constructing the recording head as a unit or combining a plurality of recording heads, and the present invention is also very effective for an apparatus provided with at least one of a composite color of different colors and a full color by a mixture of colors.

What is claimed is:

1. A liquid jet recording head comprising:

a plurality of discharge ports for discharging liquid therethrough;

a support member having a mounting surface and a plurality of liquid paths corresponding to the discharge ports;

an array of energy generating elements, corresponding to said liquid paths, provided on the mounting surface of said support member for generating energy to discharge the liquid;

a group of wirings for electrically connecting said array of energy generating elements;

a temperature detecting element for detecting temperature, said temperature detecting element being provided as a film, and extending in a direction of said energy generating element array and overlapping with said array of energy generating elements; and an insulative layer interposed between the array of energy generating elements and the temperature detecting element, the temperature detecting element being provided on the insulative layer, the array, the insulative layer and the temperature detecting element being provided in that order from the mounting surface.

2. A liquid jet recording head according to claim 1, characterized in that said temperature detecting element has at least a portion thereof formed of the same material as the material forming at least one of said energy generating elements and said wirings.

3. A liquid recording head according to claim 1, characterized in that said energy generating elements comprise electro-thermal conversion elements which generate heat in response to electrical energization.

4. A liquid jet recording head according to claim 1, characterized in that said temperature detecting element is formed of a material which is high in the rate of variation in electric conductivity with respect to temperature.

5. A base plate for a liquid jet recording head, said base plate comprising:

a support member having a mounting surface;

an array of energy generating elements, for generating energy to discharge the liquid;

a group of wiring portions for electrically connecting said energy generating elements;

a temperature detecting element for detecting temperature, said temperature detecting element being provided as a film extending in a direction of said energy generating element array and overlapping with said array of energy generating elements; and an insulative layer interposed between the array of energy generating elements and the temperature detecting element, the temperature detecting element being provided on the insulative layer, the array, the insulative layer and the temperature detecting element being provided in that order from the mounting surface.

6. A base plate for a liquid jet recording head according to claim 5, characterized in that said temperature detecting element has at least a portion thereof formed of the same material as the material forming at least one of said energy generating elements and said wiring portions.

7. A base plate for a liquid jet recording head according to claim 5, characterized in that said energy generating elements comprise electro-thermal conversion elements which generate heat in response to electrical energization.

8. A base plate for a liquid jet recording head according to claim 5, characterized in that said temperature detecting element is formed of a material which is high in the rate of variation in electric conductivity with respect to temperature.

9. A liquid recording head comprising:

a plurality of discharge ports for discharging liquid therethrough;

a support member having a mounting surface and a plurality of liquid paths corresponding to the discharge ports;

an array of energy generating elements, corresponding to said liquid paths, provided on the mounting surface of said support member for generating energy to discharge the liquid;

a group of wirings for electrically connecting said array of energy generating elements;

a temperature detecting element for detecting temperature;

an insulative layer interposed between the array of energy generating elements and the temperature detecting element, the temperature detecting element being provided on the insulative layer, the array, the insulative layer and the temperature detecting element being provided in that order from the mounting surface; and a heating element for heating said liquid, said temperature detecting element and said heating element also being provided on the mounting surface of said support member, said temperature detecting element and extending in a direction of said energy generating element array and overlapping with said energy generating elements.

10. A liquid jet recording head according to claim 9, characterized in that said temperature detecting element and said heating element have at least a portion thereof formed of the same material as the material forming at least one of said energy generating elements and said wirings.

11. A liquid jet recording head according to claim 9, characterized in that said energy generating elements comprise electro-thermal conversion elements which generate heat in response to electrical energization.

12. A liquid jet recording head according to claim 9, characterized in that said temperature detecting element is formed of a material which is high in the rate of variation in electric conductivity with respect to temperature.

13. A base plate for a liquid jet recording head, said base place comprising:

a support member having a mounting surface;

an array of energy generating elements for generating energy to discharge the liquid;

a group of wiring portions for electrically connecting said energy generating elements;

a temperature detecting element for detecting temperature, said temperature detecting element being provided as a film in a direction of said array of energy generating elements and overlapping with said array of energy generating elements;

an insulative layer interposed between the array of energy generating elements and the temperature detecting element, the temperature detecting element being provided on the insulative layer, the array, the insulative layer and the temperature detecting element being provided in that order from the mounting surface; and a heating element for heating the liquid, said heating element also being formed on said support member.

14. A base plate for a liquid jet recording head according to claim 13, characterized in that said temperature detecting element and said heating element have at least a portion thereof formed of the same material as the material forming at least one of said energy generating elements and said wiring poritons.

15. A base plate for a liquid jet recording head according to claim 13, characterized in that said energy generating elements comprise electro-thermal conversion elements which generate heat in response to electrical energization.

16. A base plate for a liquid jet recording head according to claim 13, characterized in that said temperature detecting element is formed of a material which is high in the rate of variation in electric conductivity with respect to temperature.

17. An ink jet recording apparatus comprising:

a liquid jet recording head having a plurality of discharge ports for discharging liquid therethrough, a support member having a mounting surface and a plurality of liquid paths corresponding to the discharge ports, an array of energy generating elements, corresponding to said liquid paths, provided on the mounting surface of said support member for generating energy to discharge the liquid, a group of wirings for electrically connecting said energy generating elements, and a temperature detecting element for detecting temperature, said temperature detecting element being provided as a film, said temperature detecting element extending in a direction of said energy generating element array and overlapping with said array of energy generating elements, and an insulative layer interposed between the array of energy generating elements and the temperature detecting element, the temperature detecting element being provided on the insulative layer, the array, the insulative layer and the temperature detecting element being provided in that order from the mounting surface;

conveying means for conveying a recording medium opposite to the liquid jet recording head;

recovering means for effecting a recovering process of said recording head; and control means for operating said recovering means in conformity with an output of said temperature detecting element.

18. An ink jet recording apparatus according to claim 17, characterized in that said energy generating elements comprise electro-thermal conversion elements which generate heat in response to electrical energization.

19. A liquid jet recording apparatus comprising:

a plurality of discharge ports for discharging liquid therethrough;

a support member having a mounting surface and a plurality of liquid paths corresponding to the discharge ports;

an array of energy generating elements, corresponding to said liquid paths, provided on the mounting surface of said support member for generating energy to discharge the liquid;

a group of wirings for electrically connecting said array of energy generating elements;

a temperature detecting element for detecting temperature, said temperature detecting element being provided as a film, and extending in a direction of said energy generating element array and overlapping with said array of energy generating elements;

an insulative layer interposed between the array of energy generating elements and the temperature detecting element, the temperature detecting element being provided on the insulative layer, the array, the insulative layer and the temperature detecting element being provided in that order from the mounting surface; and conveying means for conveying a recording medium opposite to the discharge ports.

20. A liquid recording apparatus comprising:

a plurality of discharge ports for discharging liquid therethrough;

a support member having a mounting surface and a plurality of liquid paths corresponding to the discharge ports;

an array of energy generating elements, corresponding to said liquid paths, provided on the mounting surface of said support member for generating energy to discharge the liquid;

a group of wirings for electrically connecting said array of energy generating elements;

a heating element, provided on the mounting surface of said support member, for heating said liquid;

a temperature detecting element for detecting temperature, said temperature detecting element being provided as a film and extending in a direction of the energy generating element array and overlapping with said energy generating elements;

an insulative layer interposed between the array of energy generating elements and the temperature detecting element, the temperature detecting element being provided on the insulative layer, the array, the insulative layer and the temperature detecting element being provided in that order from the mounting surface; and conveying means for conveying a recording medium opposite to the discharge ports.

21. An apparatus according to claim 1, wherein said heat generating sections are heat generating portions for heating liquid so that liquid is discharged and said temperature detecting film comprises tantalum (Ta).

22. A liquid recording apparatus comprising:

a plurality of discharge ports for discharging liquid therethrough;

a support member having a mounting surface and a plurality of liquid paths corresponding to the discharge ports;

an array of energy generating elements, corresponding to said liquid paths, provided on the mounting surface of said support member for generating energy to discharge the liquid;

a group of wirings for electrically connecting said array of energy generating elements;

optionally, a heating element, provided on the mounting surface of said support member, for heating said liquid;

a temperature detecting element for detecting temperature, said temperature detecting element being provided as a film and extending in a direction of the energy generating element array and overlapping with said energy generating elements;

an insulative layer interposed between the array of energy generating elements and the temperature detecting element, the temperature detecting element being provided on the insulative layer, the array, the insulative layer and the temperature detecting element being provided in that order from the mounting surface; and conveying means for conveying a recording medium opposite to the discharge ports, wherein said temperature detecting film comprises material the thermal conductivity of which varies in response to the temperature and is formed of the same material as material composing a part of the apparatus.

23. An apparatus according to any of claims 19 or 20, further comprising a heat generating section for heating said base member, which generates heat in accordance with the detection results of said temperature detecting film, at a position different from that of said plurality of heat generating sections and that of said temperature detecting section.

24. An apparatus according to claim 23, wherein said heat generating section for heating said base member is provided on both sides of a center of an area where said plurality of heat generating sections are present.

* * * * *

UNITED STATES PATENT AND TRADEMARK OFFICE

CERTIFICATE OF CORRECTION

PATENT NO. : 6,074,034
DATED : June 13, 2000
INVENTOR(S) : Hiroyuki Maeda

It is certified that error appears in the above-identified patent and that said Letters Patent is hereby corrected as shown below:

Title page,
Item [*], CPA Notice, insert -- [*] Notice: This patent issued on a continued prosecution application filed under 37 CFR 1.53(d), and is subject to the twenty year patent term provisions of 35 U.S.C. 154(a)(2). --.
Item [56], References Cited, Foreign Application Priority Data,
"48012628 2/1973" should read -- 48-012628 2/1973 --;
"50-004912 3/1973" should read -- 50-004912 3/1975 --; and
"02258266 10/1990 Japan . . . . . B41J 2/05" should be deleted.

Sheet 13 of 13,
Fig. 20, insert steps -- S5 -- and -- S7 --.

Column 1,
Line 22, "Thus" should read -- This --; and
Line 51, "has" should read -- have --.

Column 2,
Line 38, "400 dpi" should read -- 400 dpi, for --; and
Line 39, "for (i.e." should read -- (i.e., for --.

Column 3,
Line 23, "and (a" should read -- (and a --.

Column 4,
Line 19, "of" should be deleted; and
Line 21, "of" should be deleted.

Column 5,
Line 32, "of" should be deleted; and
Line 61, "of" should be deleted.

Column 6,
Line 20, "of" should be deleted; and
Line 22, "of" should be deleted.

UNITED STATES PATENT AND TRADEMARK OFFICE

CERTIFICATE OF CORRECTION

PATENT NO. : 6,074,034
DATED : June 13, 2000
INVENTOR(S) : Hiroyuki Maeda

It is certified that error appears in the above-identified patent and that said Letters Patent is hereby corrected as shown below:

Column 7,
Line 40, "all" should be deleted; and
Line 64, "heaters" should read -- heater --.

Column 8,
Line 51, "laser" should read -- lesser -- and "afore-described" should read -- aforedescribed --.

Column 9,
Line 45, "range $T_{1-T2}$." should read -- range $T_1$-$T_2$. --.

Column 10,
Line 33, "contruction" should read -- construction --.

Column 11,
Line 52, "is" should read -- in --; and
Line 55, "according to FIG. 16" should be deleted.

Column 12,
Line 4, "FIG." should read -- FIGS. --; and
Line 32, "temperature $T_O$" should read -- temperature $T_O$, --

Column 13,
Line 46, "nuclear" should read -- nucleate --.

Column 14,
Line 6, "converted" should read -- covered --.

Column 15,
Line 14, "liquid" should read -- liquid jet --;
Line 48, "comprise," should read -- comprise --; and
Line 55, "liquid" should read -- liquid jet --.

UNITED STATES PATENT AND TRADEMARK OFFICE

CERTIFICATE OF CORRECTION

PATENT NO. : 6,074,034
DATED : June 13, 2000
INVENTOR(S) : Hiroyuki Maeda

It is certified that error appears in the above-identified patent and that said Letters Patent is hereby corrected as shown below:

Column 16,
Line 12, "and" should be deleted; and
Line 30, "place" should read -- plate --.

Signed and Sealed this

Eighteenth Day of June, 2002

*Attest:*

*Attesting Officer*

JAMES E. ROGAN
*Director of the United States Patent and Trademark Office*